US008678235B2

(12) United States Patent
Barish

(10) Patent No.: US 8,678,235 B2
(45) Date of Patent: Mar. 25, 2014

(54) MULTI-ACTION TOY WATER GUN AND VARIABLE-FLUID DISCHARGE DEVICES USEFUL THEREIN

(75) Inventor: Benjamin J. Barish, Tel-Aviv (IL)

(73) Assignee: Dan Barish, West Bloomfield, MI (US)

( * ) Notice: Subject to any disclaimer, the term of this patent is extended or adjusted under 35 U.S.C. 154(b) by 1256 days.

(21) Appl. No.: 12/461,217

(22) Filed: Aug. 5, 2009

(65) Prior Publication Data

US 2010/0032449 A1 Feb. 11, 2010

Related U.S. Application Data

(60) Provisional application No. 61/193,197, filed on Nov. 4, 2008, provisional application No. 61/136,571, filed on Sep. 16, 2008, provisional application No. 61/136,018, filed on Aug. 6, 2008.

(51) Int. Cl.
*A63H 3/18* (2006.01)

(52) U.S. Cl.
USPC ..... 222/79

(58) Field of Classification Search
USPC ..... 222/78, 79, 637, 386.5, 134; 141/348; 124/69; 446/176
See application file for complete search history.

(56) References Cited

U.S. PATENT DOCUMENTS 3,116,855 A * 1/1964 Thomson ..... 222/207
4,591,071 A * 5/1986 Johnson ..... 222/39
4,678,004 A * 7/1987 Rosenberg ..... 137/469
4,757,946 A * 7/1988 Johnson ..... 239/99
4,768,681 A * 9/1988 Dean et al. ..... 222/79
4,781,217 A * 11/1988 Rosenberg ..... 137/624.14
4,854,480 A * 8/1989 Shindo ..... 222/79
5,099,876 A * 3/1992 Rosenberg ..... 137/509
5,758,800 A * 6/1998 D'Andrade ..... 222/79
5,799,828 A * 9/1998 Crawford ..... 222/79
5,819,717 A * 10/1998 Johnson et al. ..... 124/65
6,000,386 A * 12/1999 Johnson et al. ..... 124/69
6,003,503 A * 12/1999 Johnson et al. ..... 124/69
6,123,229 A * 9/2000 Barish ..... 222/79
6,802,756 B2 * 10/2004 Zimmerman ..... 446/176
7,798,364 B1 * 9/2010 Eddins et al. ..... 222/79
7,922,039 B2 * 4/2011 Jablonski et al. ..... 222/79
7,927,175 B2 * 4/2011 Coffey ..... 446/473
8,074,838 B1 * 12/2011 Tate ..... 222/79

* cited by examiner

*Primary Examiner* — Paul R Durand
*Assistant Examiner* — Donnell Long

(57) ABSTRACT

A multi-action toy water gun includes a housing including a barrel having a discharge chamber and a nozzle through which water is to be discharged; a handle grippable by one hand of a user for carrying the water gun and for aiming the barrel; a water reservoir; a manually-driven pump having a handpiece grippable by the other hand and reciprocatable along an axis parallel to that of the barrel; and a water discharge control presettable by the user to produce a large quantity discharge of water for drenching purposes, a rapid sequence of small-quantity discharges, simulating rapid shots of an automatic gun or a single small-quantity discharge simulating a single shot of a gun.

12 Claims, 9 Drawing Sheets

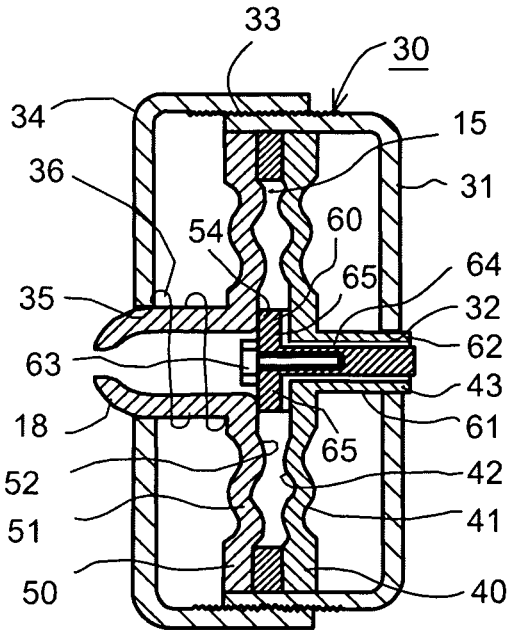
FIG.3
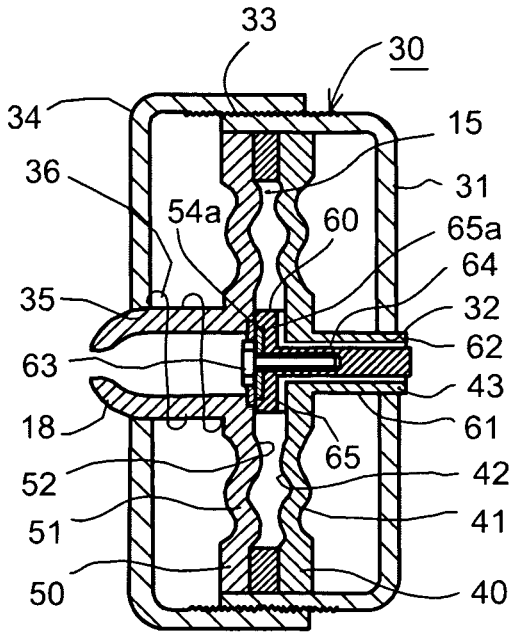
FIG.4
FIG.5
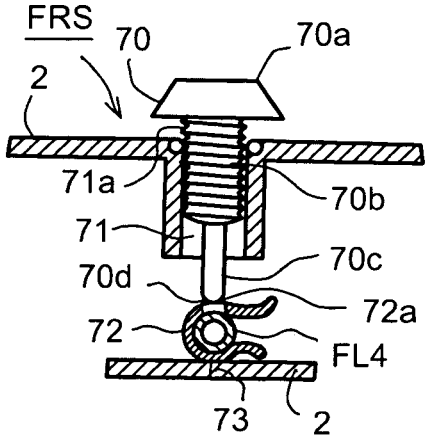

MULTI-ACTION TOY WATER GUN AND VARIABLE-FLUID DISCHARGE DEVICES USEFUL THEREIN

RELATED APPLICATIONS

This application claims the benefit of U.S. Provisional Patent Application Nos. 61/193,197 filed on Nov. 4, 2008, 61/136,571 filed on Sep. 16, 2008 and 61/136,018 filed on Aug. 6, 2008, the contents of which are incorporated herein by reference.

FIELD AND BACKGROUND OF THE INVENTION

The present invention relates to toy water guns, particularly those used by children for producing water discharges by the operation of a manual-type pump. The invention also relates to variable-fluid discharge devices particularly useful in such toy water guns.

A wide variety of toy water guns have been developed and are presently in use. The classical hand-operated toy water guns (commonly called "squirt" guns) are generally capable of producing a single type of discharge, namely a continuous stream discharge having a range according to the force applied by the user to the hand-operated pump, typically the trigger of the toy gun. In the past 20 years, a pre-pressurized "water drencher" type of toy water gun has become very popular since it is capable of discharging a large quantity of water at a relatively high pressure tending to soak or drench the target object. Also known are toy water guns, such as described in U.S. Pat. No. 5,604,253, capable of selectively producing either a continuous stream discharge or a spray discharge.

My prior U.S. Pat. No. 6,123,229 discloses a multi-action toy water gun which includes, among other features, an expansible water discharge chamber which is filled and pressurized by a manual pumping device acting on a pumping chamber communicating with the discharge chamber. The discharge chamber further includes a pressure-responsive valve which is normally closed, but automatically opens when the pressure within the discharge chamber reaches a predetermined value. The valve opening is effected with a snap-action such that the water remains in the discharge chamber until the predetermined pressure is reached, at which time the snap-opening valve effects a quick and short discharge of the pressurized water within the chamber.

The invention may be embodied in a toy water gun wherein the chamber is of small volume, such that a small-quantity, short discharge of the water is produced immediately upon the snap-action opening of the valve. Such an embodiment is particularly useful for shooting at targets to improve marksmanship. However, the invention has also been commercially embodied in a single-action toy water gun wherein the chamber is of a large volume such that a large-quantity or blast discharge is produced for soaking or drenching purposes.

OBJECTS AND BRIEF SUMMARY OF THE PRESENT INVENTION

An object of the present invention is to provide a toy water gun having advantages in a number of respects over the toy water guns heretofore developed. A more particular object of the present invention is to provide a multiple-action toy water gun which can be selectively operated to produce either large quantity blast discharges for soaking or drenching purposes (e.g., to simulate a shotgun), a rapid sequence of small quantity discharges to simulate an automatic or semi-automatic gun, and/or individual small-quantity discharges for target purposes. A further object of the invention is to provide a fluid discharge device particularly useful in such toy water guns, but also useful in other applications, such as spray coating guns, grease guns, etc.

According to one broad aspect of the present invention, there is provided a multi-action toy water gun, comprising: a housing including a gun barrel having a discharge chamber and a discharge nozzle through which water is to be discharged; a handle grippable by one hand of a user for carrying the water gun and for aiming the gun barrel towards a target; a water reservoir carried by said housing for holding a quantity of water; a manually-driven pump having a pumping chamber and a handpiece grippable by the other hand of the user and reciprocatable along an axis parallel to that of the barrel for pumping water from said water reservoir to produce a discharge of water through said nozzle via said pumping and discharge chambers; and a water discharge control presettable by the user to different preset positions enabling the user to produce, during one preset position thereof, a large quantity blast water discharge from said gun barrel towards the target for drenching purposes, and during another preset position thereof, a rapid sequence of small-quantity water discharges for simulating rapid shots of an automatic gun.

In some described preferred embodiments, the presettable water discharge, control produces, during different preselected positions thereof, not only a large quantity blast discharge for drenching purposes, or a rapid sequence of small-quantity discharges of water simulating rapid fire of an automatic gun, but also a single small-quantity discharge simulating a single shot of a gun, e.g., for target purposes.

Such toy water guns have a number of advantages. Thus, they can be used in "combat situations" as a "battlefield tactic" against a "hostile enemy", by distracting the enemy with single, small-quantity discharges until sufficiently close to surprisingly produce either a large-quantity blast discharge to drench or soak the enemy, or a rapid sequence of small-quantity discharges simulating rapid fire of an automatic gun. Another advantage is the fact that the toy water gun can also be used in "non-combat" situations, for discharging individual small-quantity shots, e.g., for target practice, marksman competitions, etc.

Several embodiments of the invention are described below for purposes of example.

One embodiment is described wherein the water gun further comprises a pivotal trigger which, when pivoted, produces a single, small-quantity discharge from the water reservoir simulating a single shot of a gun.

Other embodiments are described wherein: the water gun further comprises a second discharge chamber having a second discharge nozzle through which water is to be discharged; and the handpiece of the manually-driven pump is responsible for pumping water from the water reservoir to the first-mentioned discharge chamber to produce the large-quantity water discharge from the first mentioned nozzle for drenching purposes, or the rapid sequence of small-quantity water discharges for simulating rapid shots of an automatic gun.

In addition, the water discharge control further includes a flow-rate selector between said manually-driven pump and said discharge chamber which is presettable to produce either said large quantity water discharge or said rapid sequence of small quantity water discharges.

In one described embodiment, a second manually-driven pump pumps the water into the discharge chamber for producing each of the small-quantity discharges each simulating a single shot of a gun. In a second described embodiment, the water discharge control further includes a small-volume discharge chamber for receiving water from the second manually-driven pump and for producing each of the small-quantity discharges each simulating a single shot of a gun.

Preferably, in all the described embodiments there is a single water reservoir to produce the discharge of water through the discharge nozzle via the pumping and discharge chambers.

Further features and advantages of the invention will be apparent from the description below.

BRIEF DESCRIPTION OF THE DRAWINGS

The invention is herein described, by way of example only, with reference to the accompanying drawings, wherein:

FIG. 3 is a sectional view illustrating one form of expansible chamber and pressure-responsive valve that may be used for the large-volume water circuit, and/or for the small volume water circuit, and one means for presetting the opening pressure of the respective valve;

FIG. 4 is a similar view of FIG. 3 but illustrating a modification in the construction of the snap-action valve to simulate the sound of a "shot" during each opening and closing of the valve;

FIG. 5 illustrates one form of presettable flow regulator device that may be used as a restrictor, particularly between the pumping and water discharge chambers in the large volume water circuit, for presetting the water flow rate to the respective nozzle;

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and for other applications than described herein.

DESCRIPTION OF PREFERRED EMBODIMENTS

Overall Construction

As indicated earlier, the invention provides a toy water gun comprising: a housing including a gun barrel having a discharge chamber and a nozzle through which water is to be discharged; a handle grippable by one hand of a user for carrying the water gun and for aiming the barrel towards a target; a water reservoir for holding a quantity of water; a manually-driven pump having a pumping chamber and a handpiece grippable by the other hand of the user and reciprocatable along an axis parallel to that of the barrel for producing a discharge of water through the nozzle via the pumping and discharge chambers; and a water discharge control presettable by the user to different positions enabling the user to produce, during one preset position thereof, a large quantity blast discharge of water from the barrel towards the target for drenching purposes, and during another preset position thereof, a rapid sequence of small-quantity discharges of water for simulating rapid shots of an automatic gun.

Several embodiments of the invention are described below for purposes of example. The described embodiments are generally based on the toy water gun concept described in my prior U.S. Pat. No. 6,123,229, but it will be appreciated that the invention could also be advantageously used in other constructions of toy water guns.

The Embodiment of FIGS. 1-5

Figure 1:
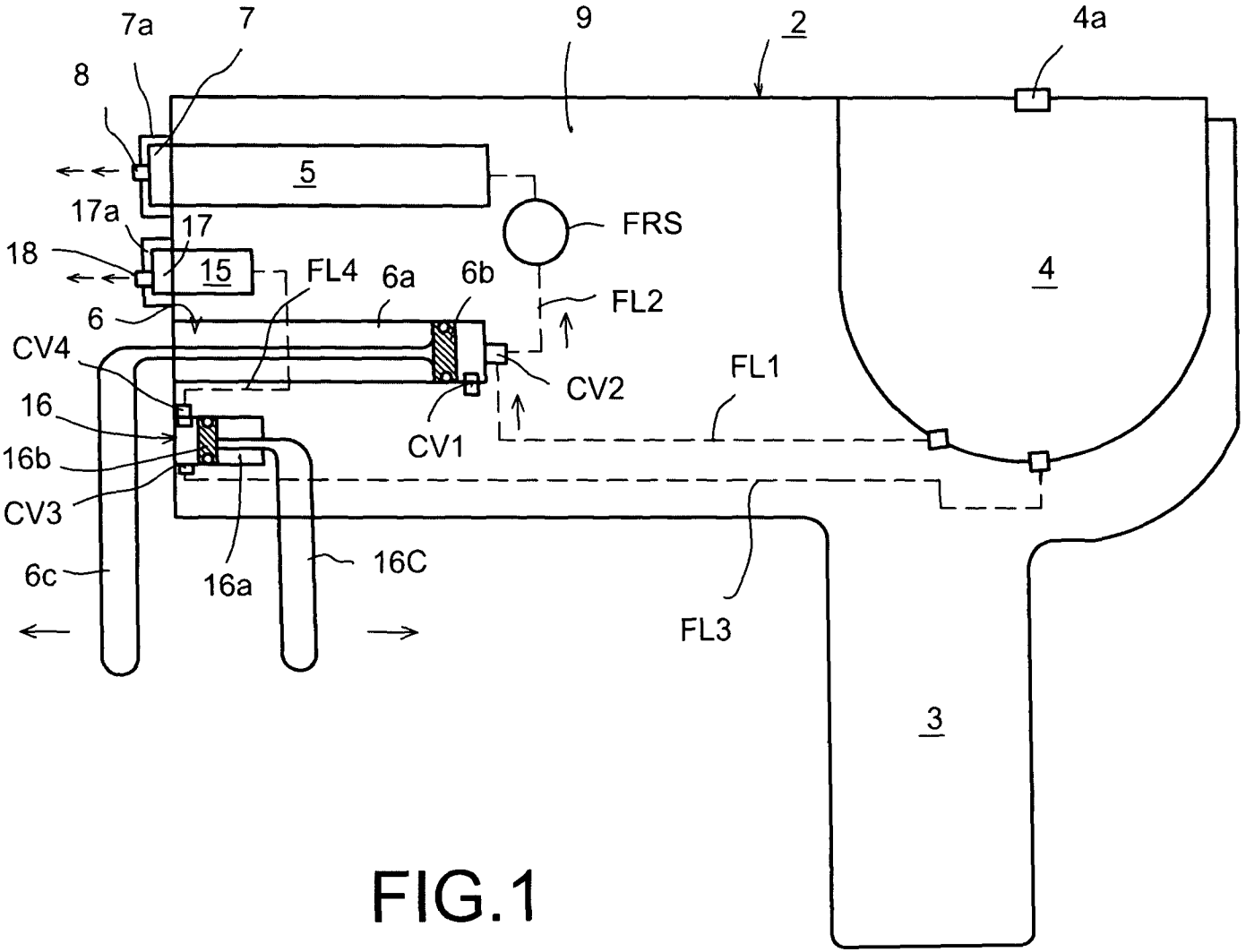
FIG. 1 is a side elevational view schematically illustrating one form of toy water gun constructed in accordance with the present invention.
Figure 2:
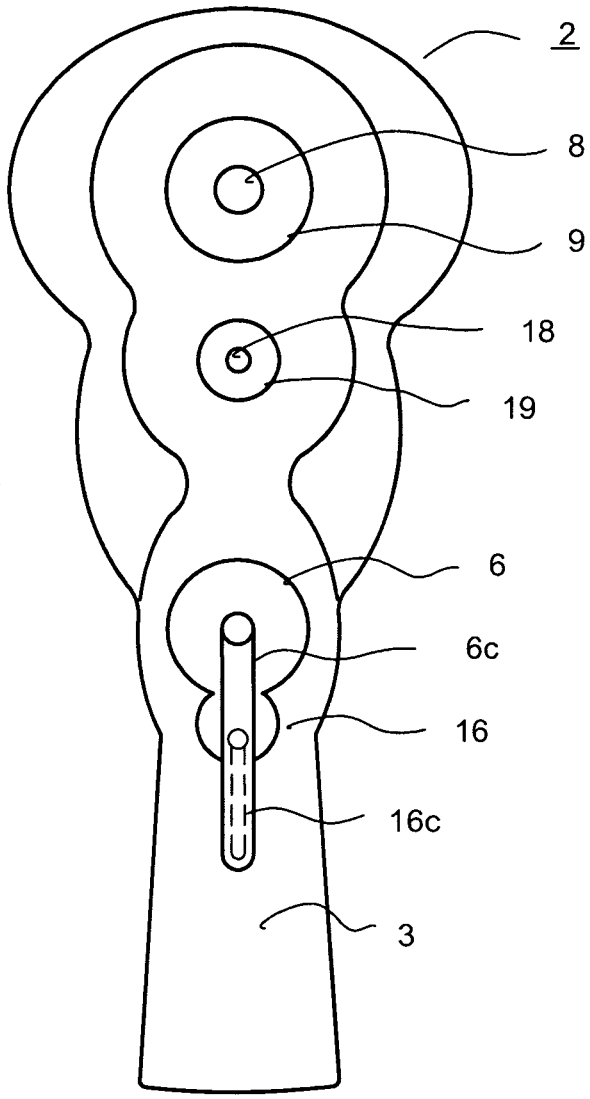
FIG. 2 is an end view of the toy water gun of FIG. 1.

As illustrated particularly in FIG. 1, the toy water gun of this embodiment includes a housing 2, a handle 3 grippable by one hand of the user for manually carrying and aiming the toy water gun, and a water reservoir 4 carried by the handle for holding a quantity of water. It also includes a large-volume discharge chamber 5 within housing 2 operatively communicating with the water in reservoir 4 via a manual pump 6.

Pump 6 includes a cylinder defining a pumping chamber 6*a*, a piston 6*b* reciprocatable within the pumping chamber, and a handpiece 6*c* grippable by the other hand of the user for moving piston 6*b* in one direction (leftwardly, FIG. 1) to draw water into the pumping chamber 6*a*, and in the opposite direction (rightwardly) to pump the water therefrom into the large-volume discharge chamber 5. Pump 6 is connected to reservoir 4 via feed line $FL_1$ and check valve $CV_1$, permitting water flow only into the pumping chamber 6*a*. The water is pumped out of pumping chamber 6*a* via another feed line $FL_2$, and another check valve $CV_2$, which permits water flow only out of the pumping chamber 6*a* into the discharge chamber 5.

The large-volume discharge chamber 5 is an expansible chamber closed at one end by a pressure-responsive valve schematically indicated at 7. Valve 7 is normally closed but automatically opens with a snap-action when the pressure within chamber 5 reaches a predetermined value, and automatically recloses, also with a snap-action, when the pressure within chamber 5 drops below a predetermined value. The predetermined value effecting the opening of the valve is presettable by a device schematically indicated at 7*a* in FIG. 1, and more particularly illustrated in FIG. 3 or FIG. 4. Discharge from chamber 5, upon the opening of valve 7, is via a nozzle 8 in the gun barrel 9 of housing 2.

It will thus be seen that when a water discharge is to be produced via nozzle 8, handpiece 6*c* of pump 6 is manually moved first outwardly (leftwardly) in order to draw water into pumping chamber 6*a* via feed line $FL_1$ and check valve $CV_1$, and then in the opposite direction (rightwardly) to force the water under pressure, via check valve $CV_2$ and feed line $FL_2$, into discharge chamber 5. As described earlier, discharge chamber 5 is normally closed by snap-action pressure-responsive valve 7, and remains closed until the pressure build-up within chamber 5 reaches a predetermined value, at which time valve 7 automatically opens with a snap-action to discharge the water in discharge chamber 5 via nozzle 8. It will thus be seen that there is no water discharge from chamber 5 until the pressure therein reaches a predetermined level, at which time water in chamber 5 is discharged as a large blast at a velocity/range according to the opening pressure of valve 7, as preset by presettable device 7*a*.

Housing 2 of the toy water gun further includes a small volume discharge chamber 15 operatively communicating with the water reservoir 4 via a small volume pump 16. Pump 16 includes a small volume pumping chamber 16*a*, a piston 16*b* displaceable within chamber 16*a*, and a handpiece 16*c* for displacing the piston. Pumping chamber 16*a* communicates with water reservoir 4 via another feed line $FL_3$ and a check valve $CV_3$ permitting water flow only into the pumping chamber. Pump 16 pumps water into the small-volume discharge chamber 15 via another feed line $FL_4$, and a check valve $CV_4$ which permits water to flow only outwardly of pumping chamber 16*a* into the small volume discharge chamber 15 upon the reciprocation of handpiece 16*c*.

The small volume discharge chamber 15 is also an expansible chamber, normally closed by a snapaction pressure-responsive valve schematically indicated at 17. Valve 17 automatically opens, by a snap action, upon the pressurization of the water within chamber 15 to a predetermined value, to thereby produce a small volume discharge via a nozzle 18. Nozzle 18 is at the end of a second barrel 19 (FIG. 2) located below, and in alignment with nozzle 8 for the large-volume chamber 5. Valve 17 also includes a presettable device 17*a* for presetting the opening pressure of the valve and, thereby, the velocity/range of its discharge.

The small volume water circuit, including the small volume pump 16 and the small volume discharge chamber 15, may be constructed substantially the same as the large-volume water circuit including the large-volume pump 6 and the large-volume discharge chamber 5, but appropriately dimensioned to handle the differences in volume involved in the two circuits. Thus, the volume of the large-volume discharge chamber 5 may be many times (e.g. 5 to 50 times) that of the small-volume discharge chamber 15 to produce the large-quantity blast discharge in the respective operation of the water discharge control.

The large volume circuit, including pump 6 and discharge chamber 5, further includes a flow rate selector FRS in the feed line $FL_2$ between pumping chamber 6 and discharge chamber 5 for fixing the flow rate of the water into chamber 5. The structure described in my above-cited U.S. Pat. No. 6,123,229 may be used for this purpose, to enable the discharges from nozzle 8 to be preset according to the type of discharge desired, e.g.: as a large-quantity blast discharge for drenching purposes; or as a rapid sequence of small-quantity discharges for rapid fire purposes, e.g., as in an automatic gun.

The latter operation can be effected by designing the snap-action valve such that it automatically recloses at a slightly lower pressure than its opening pressure. Thus, during the first operation of pump 6, the full volume within pumping chamber 6*a* is transferred to the large-volume discharge chamber 5, to thereby prime the discharge chamber. The next operation of pump 6 will force the water therefrom via flow line $FL_2$ and the flow rate selector FRS into the inlet of the large-volume discharge chamber 5, until the pressure is reached within that chamber to automatically open valve 7 with a snap-action. By designing valve 7 such that its reclosing will be at a slightly lower pressure than its opening pressure, a small discharge will be produced from its nozzle 8.

Thus, when the flow rate selector FRS, which preferably is in the form of a presettable restrictor as described below with respect to FIG. 5, is preset for minimum restriction, (i.e. for maximum flow rate), the rate of water input from pump 6 into chamber 5 will be at least equal to that of the output from nozzle 8, such that the valve will remain open for the complete stroke of pump 6, thereby producing a single large-quantity blast discharge from nozzle 8. However, if the flow rate selector FRS is preset to impose a restriction to reduce the flow rate of the water from pump 6 into discharge chamber 5 to be below the open valve output from that chamber, valve 7 will automatically reclose after a short quantity of the water has been discharged from nozzle 8, and will then automatically reopen when the pressure within that chamber builds up to the preset value in a repeating manner for the full displacement of pump 6, thereby producing a rapid sequence of small-quantity discharges simulating a rapid-fire automatic gun.

Both the large-volume discharge chamber 5, and the small volume discharge chamber 15, may be constructed as described in the above-cited U.S. Pat. No. 6,123,229, but scaled according to the volume of the water to be handled and discharged from the respective nozzles 8, 18. For convenience, FIG. 3 illustrates the small volume discharge chamber 15 and its pressure-responsive valve 17 constructed substantially as described in the above-cited U.S. patent. FIG. 4 illustrates a similar construction, but modified to include impacting elements to simulate the sounds of shots of a gun. It will be appreciated that basically the same construction may be used for the large-volume chamber 5 and its pressure-responsive valve 7, but scaled according to the larger volume to be handled by that chamber.

Thus, as shown in FIG. 3, the expansible small-volume discharge chamber 15 is housed within a housing 30 closed at one end by an end wall 31 formed with an opening 32 for receiving the inlet to the expansible discharge chamber 15. The opposite end of housing 30 is open and is formed with external threads 33, which receive a cover 34 closing that end of the housing and formed with an opening 35 for receiving the discharge nozzle 18 of discharge chamber 15. A spring 36 is interposed between cover 34 and a wall 50 of housing 30 and is effective, upon threading the cover, to apply a desired spring force restraining the expansion of the chamber according to the degree of threading of the cover.

As further shown in FIG. 3, the small-volume discharge chamber 15 is defined by two circular plates 40, 50 attached together and sealed around their outer peripheries.

Plate 40 includes an outer face 41, an inner face 42, and an inlet connector sleeve 43 passing through opening 32 in housing end wall 31, for inletting the water into chamber 15. Plate 50 includes an outer face 51 and an inner face 52. Outer face 51 is integrally formed with nozzle 18 passing through opening 35 in cover 34 for discharging the water from chamber 15. Both faces 41, 42 of plate 40 are formed with flat outer margins and with a plurality of concentric recesses decreasing in diameter inwardly from the margin towards the central sleeve 43. The recesses in the inner face 42 are aligned with the surfaces between the recesses in the outer face 41.

Plate 50 is of similar construction having outer and inner faces 51 and 52, with the concentric circular recesses on its inner face 52 being aligned with the recesses on the inner face 42 of plate 40. Plate 50 is further formed with a flat annular surface 54 coaxial with the inlet connector sleeve 43. Flat annular surface 54 serves as a valve seat in cooperation with a deformable valve member 60 located within chamber 15 for controlling the flow of water from that chamber via the outlet nozzle 18.

Deformable valve member 60 is of an elastomeric or rubber-like material and is fixed to the inner end of a stem 61 by a pin 62 having an enlarged head 63. Stem 61 is formed with a plurality of axially-extending, circumferentially-spaced, grooves 64 leading to a plurality of radially-extending grooves 65 facing the inner face of plate 40. Grooves 65 extend to points outwardly of valve member 60 so as to permit fluid to flow into chamber 15 via inlet connector 32.

Unit 30 housing the small-volume discharge chamber 15 is otherwise constructed and operates substantially as described in the above-cited U.S. Pat. No. 6,123,229.

The modification illustrated in FIG. 4 includes a similar construction as in FIG. 3, and corresponding parts are therefore identified by the same reference numerals to facilitate understanding. In the modification of FIG. 4, however, valve seat 54 includes a circular rigid (e.g., hard plastic or metal) insert 54*a*, and valve member 60 includes a similar rigid insert 65*a*, which rigid inserts impact each other to produce a sound simulating the crack of a gunshot each time the valve closes with a snap-action.

The large-volume discharge chamber 5 may be of a similar construction, but dimensioned to accommodate the large-volume of water to be received therein, rather than the small volume to be received within chamber 15. Thus, as indicated earlier, the large-volume of water within discharge chamber 5 is used to simulate a short blast discharge, e.g., for drenching or soaking purposes, or the rapid fire of an automatic gun; whereas the small volume within discharge chamber 15 is used to simulate a single gun shot, e.g., for targeting or marksmanship purposes.

The presettable flow rate selector FRS in the feed line $FL_2$ to the large-volume discharge chamber 5, may also be of substantially the same construction described in U.S. Pat. No. 2,123,229, and is reproduced in FIG. 5 for convenience.

Thus, as shown in FIG. 5, the flow rate selector FRS is a presettable restrictor which restricts water flow by pinching the feed line $FL_2$. It includes a threaded pin 70 threadedly received within a socket 71 formed in one side of housing 2, in alignment with feed line $FL_2$ feeding the water from the pump cylinder 6 to the large-volume discharge chamber 5. Feed line $FL_2$, or at least the portion of it aligned with pin 70, is made of deformable material so as to be pinched by pin 70 when threaded into the housing. Feed line $FL_2$ is preferably retained in place by a plastic clip or sleeve 72 fixed by fasteners 73 to the opposite side of the housing 2. Pin 70 includes an enlarged head or knob 70*a* externally of housing 2. It has a large-diameter shank section 70*b* threadedly received within socket 71 of housing 2, and a smaller-diameter shank section 70*c* passing through an opening 72*a* in the plastic sleeve 72, and having a rounded tip 70*d* engageable with feed line $FL_2$ to pinch the feed line according to the degree of threading of pin 70 in socket 71. An O-ring 71, between shank section 70*b* of pin 70 and the wall of housing 2 defining socket 71, prevents leakage of water from the reservoir 5 within the water pistol.

Pin 70 may thus be rotated to raise its tip 70*d* out of contact with feed line $FL_2$ to produce a maximum inflow of water into the large-volume discharge chamber 5, or to lower its tip to pinch the feed line $FL_2$ in order to restrict the inflow rate as desired. As indicated above, producing a maximum inflow, i.e. at a rate greater than the outflow rate from discharge chamber 5, will retain valve 7 open, once opened, and will thereby produce a single, large-quantity, blast discharge for the complete stroke of pump 6. On the other hand, presetting pin 70 to pinch the water feed line $FL_2$ sufficiently to restrict the flow inletted into discharge chamber 5 to a rate below the rate outletted from the chamber when valve 7 is opened, will produce a series of short small-volume discharges spaced from each other according to the reduced inletted flow rate. The flow rate may be so restricted such as to produce relatively small intervals between the individual discharges to therefore simulate the rapid fire of an automatic gun.

The user may thus select either a single large-volume blast discharge via nozzle 8, by rotating pin 70 in one direction, or a sequence of small-volume discharges simulating rapid fire of an automatic gun by rotating pin 70 in the opposite direction. The volume of the large-volume pump chamber 6*a* of pump 6 may be substantially the same as that of the large-volume discharge chamber 5. Thus, pump 6 would first be actuated in order to fill chamber 5, whereupon each subsequent actuation of the pump will produce the type of discharge described above according to the presetting of the flow rate selector FRS.

On the other hand, if a single small-volume discharge is desired via nozzle 18, this is produced by reciprocating handle 16*c* of the small-volume pump 16. The volume of pump-chamber 16*a* of this pump is substantially the same as the volume of the small-volume discharge chamber 15, so that the first reciprocation of the pump will fill chamber 15; whereas each subsequent reciprocation of the pump will produce a single small-volume discharge from nozzle 18 corresponding to the volume of cylinder 16*a* of the small-volume pump 16.

Operation of the Embodiment of FIGS. 1-5

The operation of the toy water gun illustrated in FIGS. 1-5 will be apparent from the above description.

Thus, the flow-rate selector FRS, when included in the inlet line $FL_2$ to the large-volume discharge chamber 5, may be preset in the manner described above according to the water flow rate desired for producing either a large-volume blast discharge or a sequence of small volume discharges from chamber 5 through its nozzle 8 during each operation of handpiece 6*c*. In addition, the velocity/range of the discharges from the large-volume discharge chamber 5, as well as from the small-volume chamber 15, may be preset by rotating collar 34 (FIG. 3) of the respective valve 7, 17, to compress or expand spring 36 in order to preset the valve opening pressure, and thereby to produce the desired velocity/range of the respective water discharge. This enables the velocity/range of the discharges from each chamber 5, 15, via its respective nozzle 8, 18, to be preset, e.g., according to the physical strength of the user.

After the foregoing devices have been preset, water reservoir 4 is filled with water. For this purpose, the reservoir may be provided with a fill cap 4*a* covering an inlet port for filling the reservoir; alternatively, or in addition, the left end of water reservoir 4 may be provided with threads for attaching the reservoir to the housing, to permit separate filling of the reservoir and then, its attachment to the housing.

The toy water gun is now in condition for use, for producing any one of the three types of discharges from chamber 5 via nozzle 8, or from chamber 15 via nozzle 18. For this purpose, handle 3 of the gun is grasped by one hand and aimed at the intended target, while one of the handpieces 6*c* or 16*c* is grasped by the other hand and reciprocated in one direction, and then in the opposite direction, both parallel to the longitudinal axis of the gun barrel 9, to produce the respective type of discharge.

Thus, if a single small-volume discharge is desired, handpiece 16*c* is moved first rightwardly (FIG. 1) in order to draw water into pump cylinder 16 from water reservoir 4, and then leftwardly to pump the water into the small-volume discharge chamber 15, until its pressure-responsive valve 17 opens (with a snap-action) to produce a small volume discharge from nozzle 18. As indicated earlier, the velocity/range of the small-volume discharges can be preset by rotating collar 34 in the small volume chamber 15.

Whenever it is desired to produce a large-volume blast discharge, e.g. for soaking or drenching purposes, or a rapid sequence of small-volume discharges, handpiece 6*c* is first moved (leftwardly in FIG. 1) to draw water into the large-volume pump cylinder 6*c* from the water reservoir 4, and then rightwardly to pump the water into chamber 5, first to prime the chamber, and then to pump further water into the chamber until its valve 7 snaps open. As indicated above, if the flow regulator selector FRS in feedline $FL_2$ is fully open, a large-volume blast discharge will be produced, whereas if the flow rate selector FRS is preset for a reduced flow rate, a sequence of small-volume discharges will be produced simulating the rapid fire of an automatic gun.

When the sound-producing feature illustrated in FIG. 4 is included, each snap-action closing of the valve 17 will produce a sharp sound or noise by the impact of rigid insert 54*a* of valve seat 54, and rigid insert 64*a* of valve member 64. Thus, operating the toy water gun according to the single-shot mode will produce a single impact sound simulating that of a single-shot; and operating the toy water gun according to the repeating-shot mode will produce a series of sound impacts simulating the rapid fire of an automatic gun.

As seen in FIG. 1, the small volume pump cylinder 16 is connected to a lower point of water reservoir 4 (via feed line $FL_3$) than the large-volume pump cylinder 6*a* (via feed line $FL_1$), so that after the water in the reservoir becomes insufficient for producing large-quantity blasts, there will still be sufficient water to produce single small-quantity discharges. Also, nozzle 18 may be of smaller cross-sectional area than nozzle 8, to produce discharges of smaller cross-sectional area.

Figures 6, 7:
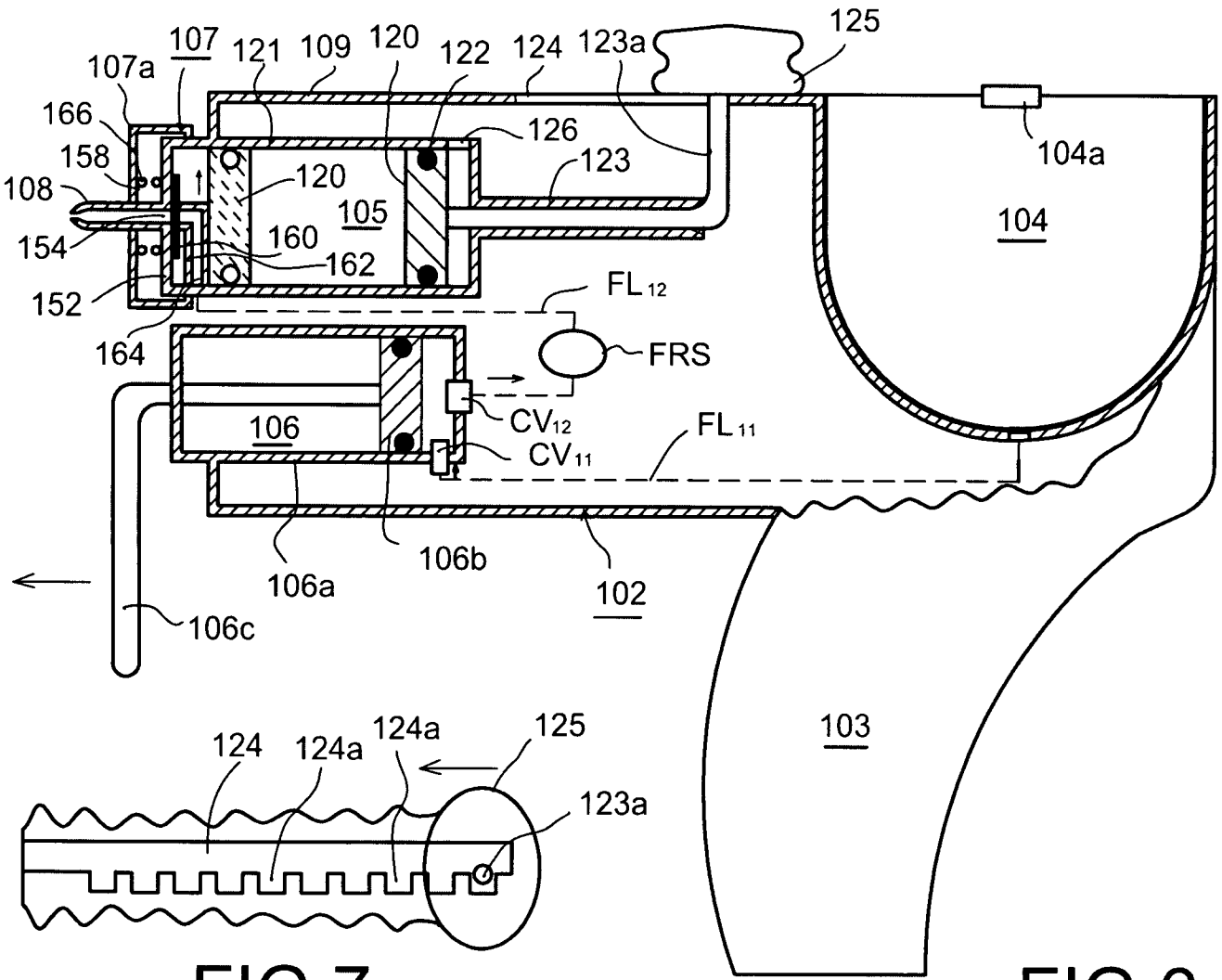
FIG. 6 schematically illustrates another toy water gun constructed in accordance with the present invention, to include a single, variable-volume discharge chamber.
FIG. 7 is a fragmentary top view of a portion of FIG. 6.

The Embodiment of FIGS. 6 and 7

The toy water gun illustrated in FIGS. 6 and 7 differs from that of FIGS. 1-5 mainly in the fact that the FIGS. 6 and 7 embodiment includes a single discharge chamber of variable-volume which may be presettable, rather than two chambers each of a fixed volume. Such an arrangement greatly simplifies the construction of the toy water gun, since it requires only one discharge chamber, and also only one manually-driven pumping chamber and one snap-action pressure-responsive valve, rather than two of each.

Thus, the toy water gun schematically illustrated in FIGS. 6 and 7 also includes a housing 102, a handle 103 graspable by one hand of the user for manually carrying and aiming the toy water gun, and a water reservoir 104 having a refill cap 104*a* carried by the handle for holding a quantity of water. In this case, however, there is only a single discharge chamber 105 within housing 102 which operatively communicates with the water reservoir 104 via a single manual pump 106. One end of discharge chamber 105 is normally closed by a snap-action pressure-responsive valve 107, whose opening pressure can be preset by a presettable device 107*a*, similar to the arrangement described above with respect to FIGS. 1-5, for producing the various types of water discharges from a single nozzle 108.

In the embodiment of FIGS. 6 and 7, pump 106 also includes a pumping chamber 106*a*, a piston 106*b* movable therein, and a handpiece 106*c* graspable by the other hand of the user for moving piston 106*b* in one direction (leftwardly, FIG. 6) to draw water into the pumping chamber 106*a*, and in the opposite direction (rightwardly) to pump the water from pumping chamber 106*a* into discharge chamber 105. Pump 106 is connected to reservoir 104 via a feed line $FL_{11}$, and a check valve $CV_{11}$, permitting water flow into the pumping chamber 106*a*. The water is pumped out of chamber 106*a* via another feed line $FL_{12}$, another check valve $CV_{12}$, and flow rate selector FRS, which controls the water flow rate into discharge chamber 105.

Instead of having a second discharge chamber (corresponding to chamber 15 in FIGS. 1-5), and a second pump (corresponding to pump 16), discharge chamber 105 is constructed so as to define a variable volume which can be manually preset to serve the same functions as the large-volume discharge chamber 5 and the small-volume discharge chamber 15 in the FIGS. 1-5 construction.

Thus, as shown in FIG. 6, discharge chamber 105 is defined by a plunger 120 movable within a cylinder 121 formed in barrel 109 of the toy water gun and carrying a sealing ring 122 to define a discharge chamber 105 whose volume varies according to the axial position of plunger 120 within cylinder 121. Plunger 120 is fixed to a rod 123 which includes an upwardly bent section 123*a* extending through a slot 124 in the upper wall of housing 102. Rod section 123*a* carries a manually graspable handpiece 125 for moving plunger 120 within cylinder 121 in order to preset the volume of chamber 105. FIG. 6 illustrates, in full lines, the outermost position of plunger 120 to define the maximum volume of chamber 105, and in broken lines the innermost position of the plunger to define the minimum volume of chamber 105.

Slot 124 is formed with a plurality of locking recesses 124*a* (FIG. 7) for selectively receiving rod section 123*a* in order to lock the plunger 120 within the cylinder 121 at a selected position to define the volume of chamber 105 desired according to the selected mode of operation of the gun.

Variable-volume discharge chamber 105 also includes a snap-action pressure-responsive valve 107 at the outlet side of the chamber. However, since the volume of chamber 105 is presettable (by plunger 120 and handpiece 125), the structure of the valve is preferably somewhat different from that of FIGS. 1-5.

Thus, as shown in FIG. 6, the outlet end of discharge chamber 105 is also closed by an elastically deformable wall 152 formed with an opening 154 defining a valve seat, which opening is normally closed by a membrane valve member 160. In this case, however, valve member 160 is carried by a post 162 fixed within chamber 105 adjacent to its elastic wall 152. Post 162 is formed with a water passageway 164 connected to feed line $FL_{12}$ for feeding the water into chamber 105 in order to pressurize the water therein.

The snap-action valve, constituted of valve member 160, operates in substantially the same manner as described above with respect to FIGS. 1-5. That is, valve member 160 normally closes valve opening 154, to prevent a discharge of water from discharge chamber 105 until the pressure builds-up therein to a predetermined value, whereupon valve member 160 snaps open, as described above with respect to FIGS. 1-5, to quickly discharge the water within discharge chamber 105, and then it recloses.

As in FIGS. 1-5, the toy water gun illustrated in FIG. 6 also includes a flow rate selector FRS in the feed line $FL_{12}$ from pump 106 to discharge chamber 105 to select the flow rate of the water into chamber 105 and thereby the discharge rate from that chamber to produce either a large-quantity blast discharge, or a sequence of small-quantity discharges, as in the FIGS. 1-5 embodiment. Pump 106 includes a pumping chamber 106*a*, a piston 106*b* movable therein, and a handpiece 106*c* for manually moving the piston.

Further, as in FIGS. 1-5, the toy water gun of FIG. 6 also includes an arrangement, schematically indicated at 107*a*, for presetting the opening pressure of the snap-action valve. This presetting arrangement includes a spring 166 between elastic wall 152 and an outer collar 158 threadedly received over the discharge end of the gun barrel 109. It will be appreciated that the modification illustrated in FIG. 4 could also be used to produce sounds simulating the sounds produced by semi-automatic and automatic guns, as described above with respect to FIG. 4.

Operation of the FIGS. 6 and 7 Embodiment

The toy water gun illustrated in FIGS. 6 and 7 operates in substantially the same manner as described above with respect to FIGS. 1-5, except that it does not include a large-volume discharge chamber (5) and a small-volume discharge chamber (15); rather, it includes but a single discharge chamber 105 whose volume can be preset by plunger 120 and handpiece 125, to define either a large-volume discharge chamber or a small-volume discharge chamber. Accordingly, only a single pump 106 and only a single snap-action pressure-responsive valve 107 are required.

The volume of chamber 105 may be manually preset by grasping handpiece 125 and moving it within slot 124 of the housing, to thereby move the plunger 120 to any desired position within chamber 105. The plunger may be locked in the selected position by merely pivoting the handpiece slightly to move the rod section 123*a* into a selected recess 124*a* of the slot, as shown in FIG. 7.

Thus, if a high-volume discharge is desired, plunger 120 would be preset by handpiece 125 to the rightmost (full-line) position of the plunger, whereby chamber 105 will have a large-volume, corresponding to the volume of chamber 5 in FIG. 1. When plunger 120 is so preset, and the snap-action pressure-responsive valve 107 is preset as described above with respect to FIGS. 1-5, handpiece 106*c* of pump 106 may be moved first leftwardly to draw water from reservoir 104 into pumping chamber 106*a*, via feedline $FL_{11}$, and then rightwardly to pump the water therein, via check valve $CV_{12}$ and feedline $FL_{12}$, into the large-volume discharge chamber 105. This pumping action occurs until the pressure within that chamber reaches a predetermined magnitude, as preset by collar 158, to cause valve member 160 to open with a snap-action with respect to valve opening 154 in elastic wall 152.

If a large-volume blast discharge is desired, the flow rate selector FRS would have been preset to its maximum open position, to permit the large-volume chamber 105 to rapidly refill at a rate equal to, preferably larger than, its discharge rate. If, on the other hand, a sequence of small-volume discharges is desired (e.g. to simulate the rapid fire of an automatic gun), the flow rate selector FRS would have been preset to a restricted open position, so as to restrict the inflow rate into discharge chamber 105 to be lower than its discharge rate in the valve-open position, and thereby cause the valve automatically to reclose each time a small quantity of the water has been discharged.

However, when plunger 120 is moved (leftwardly) and locked in another position, it defines a smaller-volume discharge chamber 105. During this mode, single-shot, small-volume discharges would be produced.

The volume of water in each discharge will be determined by the preset position of plunger 102, and the spacing of the discharges will be determined by the preset position of the flow rate selector FRS.

Valve member 160 and valve opening 154 may also include rigid (e.g. metal or hard plastic) rings or surfaces (54*a*. 65*a*, FIG. 4) which impact together during each snap-action closing of the valve, thereby producing sounds simulating the gun-shots of a gun.

Handpiece 125 may also be used to substantially empty discharge chamber 105 of water when the gun is no longer to be used, by moving the handpiece (leftwardly, FIG. 6) to the innermost (broken-line) position of plunger 120, thereby snap-opening valve 107. In addition, the inner face of plunger 120 (i.e., facing post 162) may be configured for receiving post 162, as well as valve member 160, in order to purge all the water from chamber 105, and also to lock the water gun against use.

When plunger 120 is moved in the opposite direction, i.e., rightwardly in FIG. 7, to increase the volume of chamber 105, the suction within that chamber will be neutralized by opening of valve member 160, and the increased pressure at the opposite side the plunger will be vented to the atmosphere via vent 126.

Figure 8:
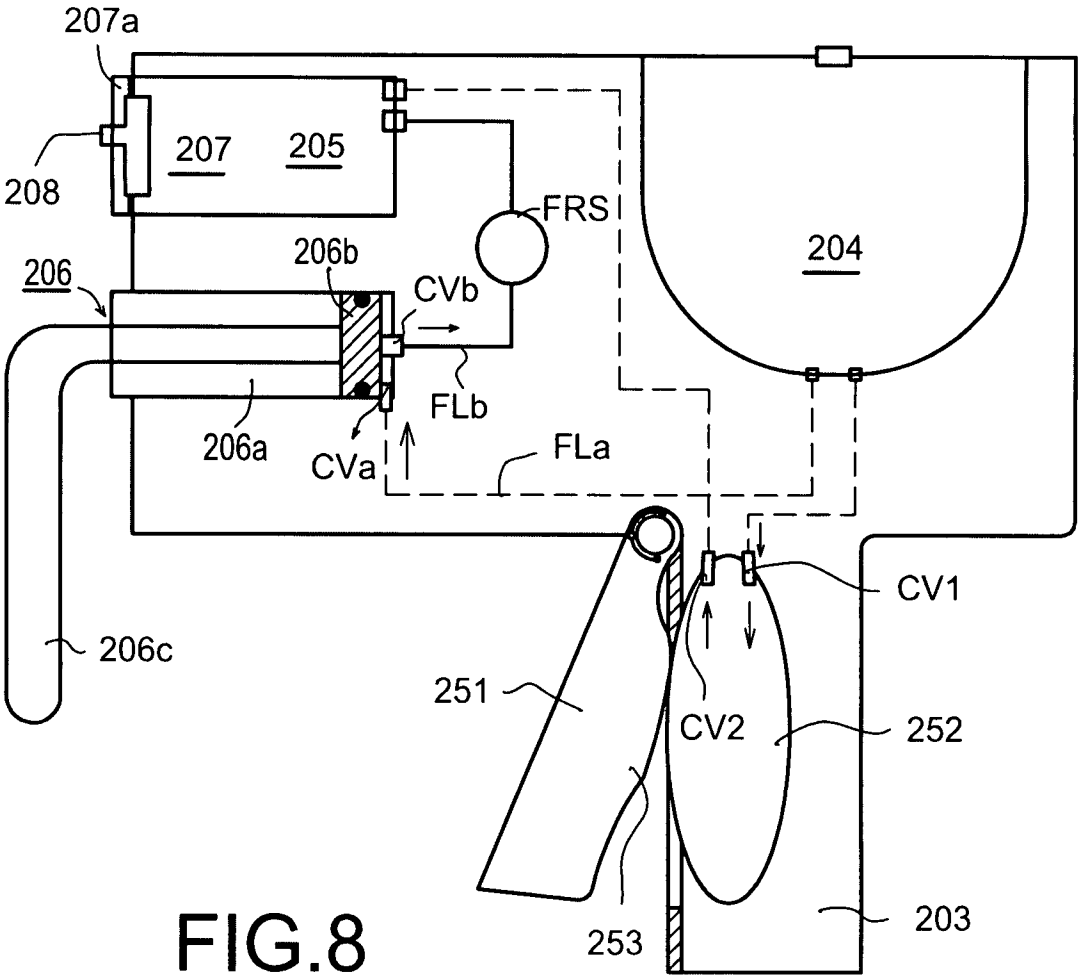
FIGS. 8 and 9 schematically illustrate two further toy water guns constructed in accordance with the invention including a pivotally-mounted trigger adjacent to the handle for producing single small-quantity discharges, e.g. for marksmanship or competitive purposes.
Figure 9:
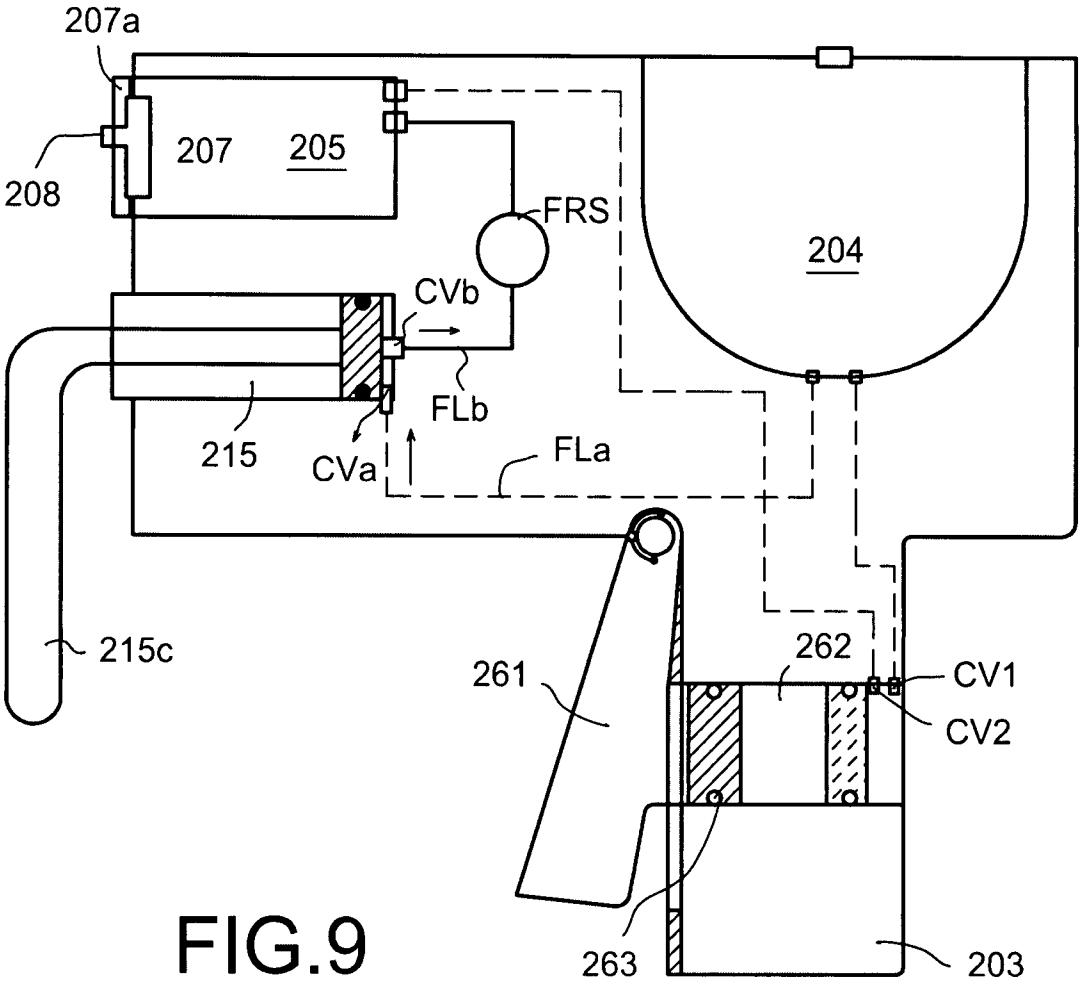

The Embodiments of FIGS. 8 and 9

FIG. 8 schematically illustrates a further embodiment of the invention, in which the toy water gun, particularly the water discharge control, also includes two pumps, and a single discharge chamber. In this case, the volume of one pump is substantially equal to that of the discharge chamber, whereas that of the second pump is substantially smaller since it is used only to produce the single-shot small-volume discharges.

Thus, the toy water gun illustrated in FIG. 8 includes a single large-volume discharge chamber 205 and a large-volume pump 206 having a pumping chamber 206*a*, piston 206*b*, and handpiece 206*c*, corresponding to pumps 5 and 105 in FIGS. 1 and 6. Pump 206 is connected to the water reservoir 204 by a feed line FLa and a check valve CVa, and is connected to the discharge chamber 205 via a second check valve CVb, feed line FLb and the flow rate selector FRS, all as described above with respect to the FIGS. 1-5 embodiment. In addition, discharge chamber 205 includes a pressure-responsive snap-action valve 207, a presettable valve-opening device 207*a*, and a discharge nozzle 208, all corresponding to elements 7, 7*a* and 8 in FIG. 1.

As distinguished from the construction in FIG. 1, the toy water gun illustrated in FIG. 8 does not include a second discharge chamber or a second pressure-responsive valve. The volume of pump 206 is substantially the same as that of the large-volume discharge chamber 205, such that the first complete reciprocation of the pump piston 206*b* will substantially fill the volume of discharge chamber 205 but will not open the snap-action valve 207. The first reciprocation of the pump thus "primes" the discharge chamber 205, such that a subsequent operation of pump 206 will produce either the large-volume blast discharge, or the sequence of small-volume discharges simulating a rapid fire, according the presetting of the flow rate selector FRS as discussed above.

In order to produce the one-shot small-volume discharges, the toy water gun illustrated in FIG. 8 includes a pivotal trigger 251 adjacent to handle 203 for actuating a second pump within the handle. In the embodiment of FIG. 8, the second pump within handle 203 is in the form of a squeeze bulb, as shown at 252, engageable by a bulge 253 of trigger 251, so as to be squeezed when the trigger is pivoted towards the handle by the user's hand gripping the handle. Bulb 252 includes a connection to the water reservoir 204 via a check valve $CV_1$ permitting only the inflow of the water into the bulb, and a connection to the large-volume discharge chamber 205 by a second check valve $CV_2$, permitting only the outflow of the water from the bulb into chamber 205. Bulb 252 would be sized so as to have the desired volume of a one-shot discharge, e.g. for marksmanship or target practice.

It will thus be seen that once the large-volume pump 206 has been actuated to fill discharge chamber 205, a subsequent actuation of the pump 206 will produce either the large-volume blast discharge, or the sequence of small-volume rapid-fire discharges, according to the setting of the flow rate selector FRS. Both types of discharges will be via nozzle 208. On the other hand, whenever a single-shot small-volume discharge is desired, e.g. for targeting or marksmanship purposes, trigger 251 is pivoted to squeeze bulb 252 and thereby to force water from the bulb into chamber 205 until its valve 207 opens to produce a single-shot small-volume discharge via nozzle 208.

In substantially all other respects, the toy water gun illustrated in FIG. 8 is constructed and operates in substantially the same manner as described above with respect to the FIGS. 1-5 embodiment.

FIG. 9 illustrates a toy water gun of very similar construction as in FIG. 8, and therefore corresponding parts have been identified by the same reference numerals in order to facilitate understanding. The toy water gun illustrated in FIG. 9, however, includes a pump within its handle 203 in the form of a cylinder 262 receiving a piston 263 carried by the pivotal trigger 261 adjacent to the handle 203. As in the case of FIG. 8, the volume of pump cylinder 262 within handle 203 would be the desired volume of water to be included in each single-shot small-volume discharge for targeting or marksmanship purposes.

Figure 10:
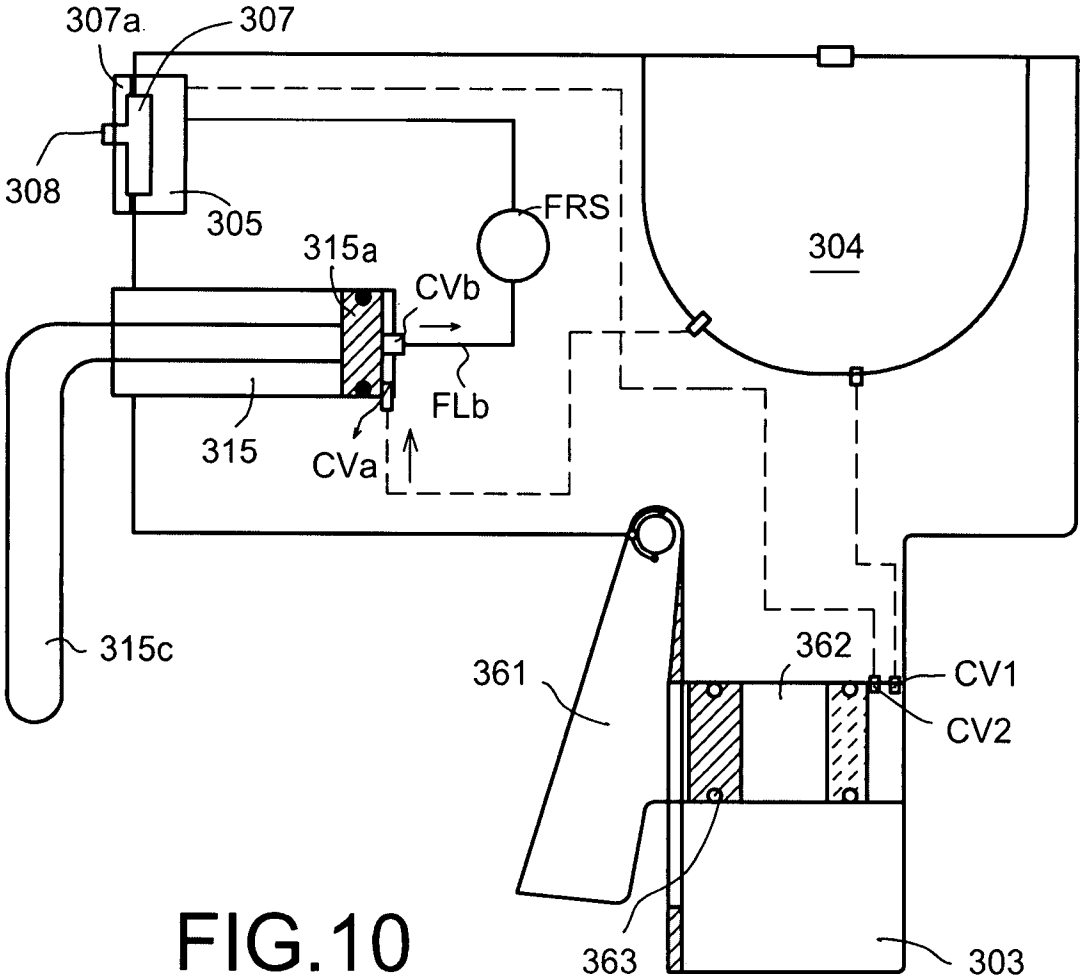
FIGS. 10 and 11 illustrate two further embodiments of the invention.
Figure 11:
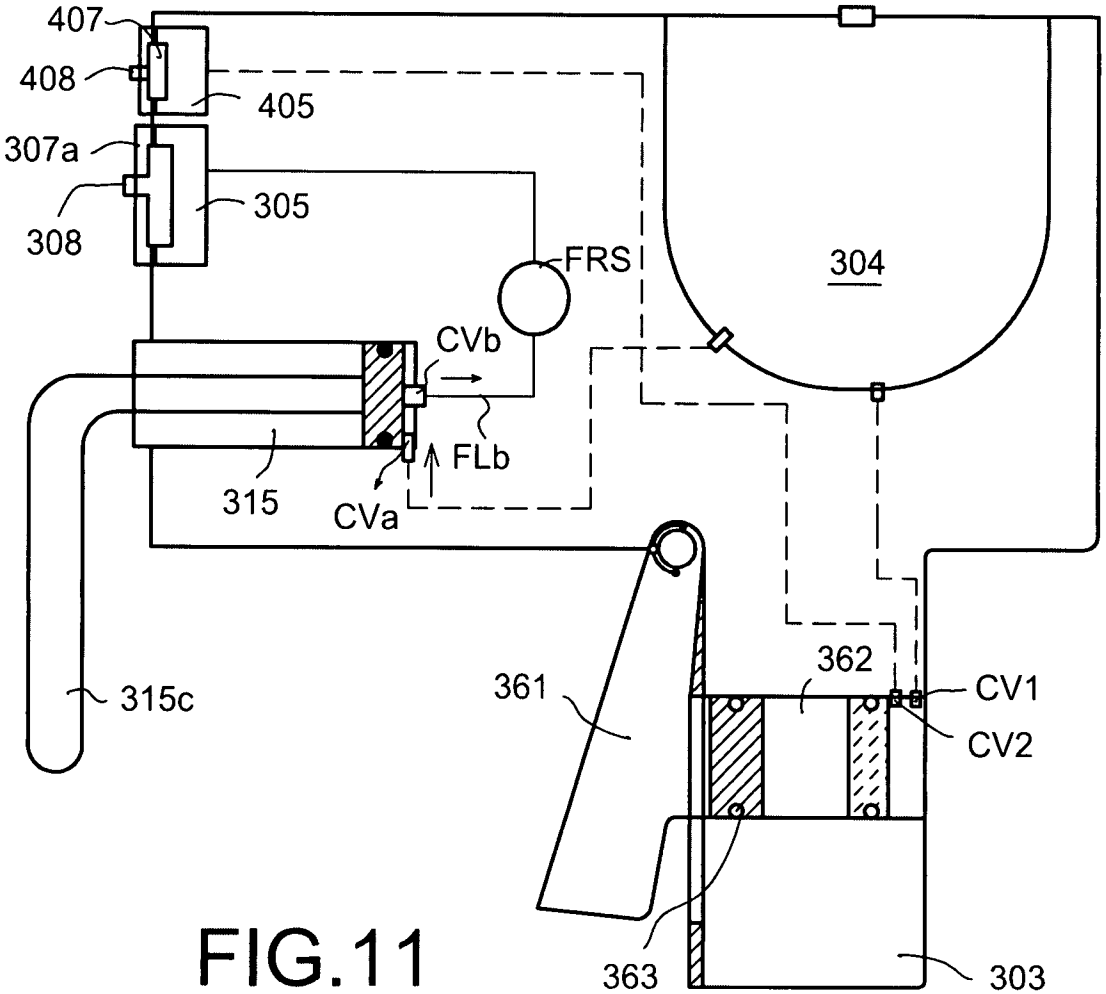

The Embodiments of FIGS. 10 and 11

FIG. 10 illustrates a construction similar to that of FIG. 9, except that the discharge chamber 305 is of relatively small volume, whereas the pump 315 includes a pumping chamber having a volume many times that of the discharge chamber, e.g. from 5-15 times. Pumping chamber 315*a* is connected via flow rate selector FRS to the inlet end of discharge chamber 305. The opposite end of the discharge includes a pressure-sensitive snap-action valve 207 presettable by rotatable collar 207*a* for controlling the discharge of the water via discharge nozzle 208, in the same manner as described above with respect to the other constructions, and as more particularly illustrated in FIGS. 3 and 4 of the drawings.

It will thus be seen that when handle 315*c* of pump 315 is reciprocated, the water therein will be pumped via flow rate selector FRS into the input end of discharge chamber 305, which will discharge a relatively small quantity of water via its nozzle 308 when the pressure builds up to that preset in the pressure-sensitive valve 307. If flow rate selector FRS had been preset for maximum flow, an inflow into discharge chamber 305 great than the outflow therefrom in the valve-open position, the quick movement of handle 315*c* of pump 315 in the pumping direction (rightwardly, FIG. 10) will pump the water therefrom into the inlet end of discharge chamber 305, via flow rate selector FRS at a rate sufficiently high to prevent the drop of pressure within discharge chamber 305, so that the valve will remain open producing a blast of the full quantity of water within pump chamber 315. On the other hand, if flow regulator selector FRS is preset for a reduced flow rate into discharge chamber 305, each discharge via pressure-sensitive valve 207 will lower the pressure within the chamber so as to reclose the valve; and then, as the water refills the chamber, the valve will again reopen, thereby producing a rapid sequence of small-quantity discharges via nozzle 208.

FIG. 11 illustrates a variation, wherein a separate discharge chamber 405 is provided, including a separate pressure-sensitive valve 407 and nozzle 408 for discharging the small-quantity individual discharges by the operation of a manually-driven pump in the handle, as in FIG. 10. Such a modification has the advantage that discharge chamber 405 may be made of even smaller volume than discharge chamber 305, and/or corresponding nozzle 408 may be of smaller cross-section than nozzle 308, so that the individual discharges, simulating single shots of a gun, can each be of even a smaller quantity of water than each of the small-quantity discharges in the rapid sequence discharges. In addition, providing a separate nozzle, preferably at the upper end of the barrel, better enables the gun to be used for sighting targets when operating the gun in the single-shot mode.

Figure 12:
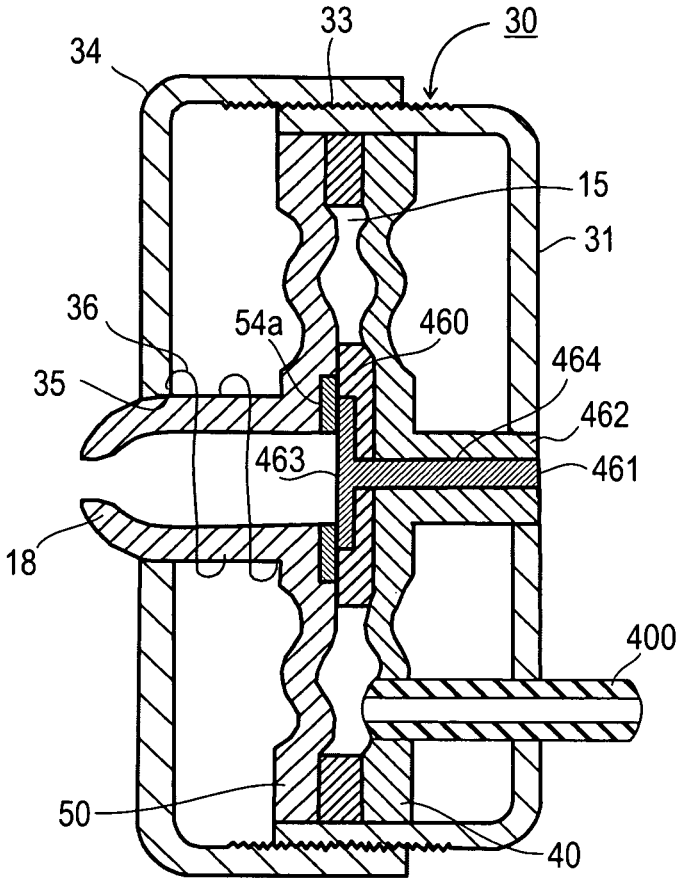
FIG. 12 illustrates a modification of the water discharge chamber, particularly that shown in FIG. 4, which may be used in any of the above-described embodiments of the invention.

FIG. 12 Modification in the Discharge Chamber Construction

FIG. 12 illustrates a modification in the construction of the discharge chamber that may be used in any of the above-described embodiments. The discharge chamber illustrated in FIG. 12 is similar to that of FIG. 4 but is modified so that the inlet to the discharge chamber is not centrally of the chamber coaxial with the valve member, but rather is laterally of the chamber, laterally of the valve member. An advantage of such a construction is that it permits the inlet to the discharge chamber to be separate from the valve mounting, thereby better enabling the inlet to provide an inlet flow rate into the chamber greater than the outlet flow rate via the nozzle in the open condition of the valve, and further, to permit the inlet to be laterally of the valve member such as to produce less turbulence in the water to the nozzle in the open condition of the valve member.

To facilitate understanding, the elements in the discharge chamber construction listed in FIG. 12 which are generally the same or similar to those in the FIG. 4 construction are identified by the same reference numerals; whereas the newly-added elements, or those modified in the FIG. 12 construction are identified by reference numerals in the "400" series.

Thus, as shown in FIG. 12, the inlet into the small-volume discharge chamber 15 is not through the valve mounting, but rather through an inlet tube 400 laterally of the valve mounting. As indicated earlier, the diameter of inlet tube 400 is of a size to permit a greater inlet flow rate into chamber 15, than the outlet rate via nozzle 18 in the fully-open condition of the valve.

In addition, the valve member 460 is fixed by a pin 461 passing through a tubular formation 462 in wall 40 of the discharge chamber 15 and having an enlarged head 463 facing the inserts 54*a* circumscribing the opening in wall 50 defining the valve opening. In this case, however, head 463 is enlarged so as to engage insert 54*a* during each closing of the valve, and thereby to produce a sound impact simulating a shot of a gun during each closing of the valve. Insert 54*a* and enlarged head 463 of pin 461 may both be made of metal or of a hard plastic so as to produce an impact sound with each closing of the valve.

As indicated earlier, such a modification not only more conveniently permits the inlet flow rate into chamber 15 to be larger than the outlet flow-rate from the chamber during the open position of the valve, e.g. during a blast discharge mode of operation of the gun, thereby better assuring that the valve will remain open for the full blast discharge, but also inlets the water laterally of the valve member, rather than coaxially therewith as in the FIG. 4 embodiment, thereby producing less turbulence and a greater range of the blast discharge.

Otherwise, the discharge chamber illustrated in FIG. 12, and operates in substantially the same manner, as those described above with FIGS. 3 and 4, and may also be used in all the embodiments of the invention described above.

Other Variations, Modifications and Applications of the Invention

While the invention has been described with respect to several preferred embodiments, it will be appreciated that many other variations may be made. For example, the large-volume discharges could be produced by pre-pumping as in the toy water guns heretofore used. In addition, other manual pumping arrangements could be used for one or both of the discharge chambers in FIGS. 1-5, such as pivotal handpieces, rather than slidable handpieces. Further, other pressure-responsive valves could be used, including ball valves, and the like. Yet another possible modification in some of the embodiments would be to mount the two nozzles 8, 18 in horizontal alignment, or coaxially to facilitate aiming, rather than in vertical alignment as illustrated particularly in FIG. 2.

It will be further appreciated that in the FIGS. 6 and 7 embodiment, other means may be provided for presetting plunger 120 to define the desired volume of chamber 105. For example, this presetting function could be performed by a rotatable knob, a pivotal lever, a nut-and-screw mechanism connected to plunger 120, etc. Also, the pivotal trigger of FIGS. 8 and 9 could also be used for the small-volume pump in FIGS. 1-5.

It will also be appreciated that the arrangement illustrated in the embodiment of FIGS. 6 and 7 could be used in other types of fluid discharge devices wherein the volume of the fluid discharged is to be presettable or varied by the user. For example, such a fluid discharge arrangement could be included in other types of guns, e.g., for discharging blasts of air for launching projectiles, such as "Nerf" balls, suction darts, ping-pong balls, and the like. Such a construction could also be used in industrial applications, e.g., for discharging preselected quantities of a liquid in a sprayer, grease gun, or the like.

Many other variations, modifications and applications of the invention will be apparent.

What is claimed is:

1. A multi-action toy water gun, comprising:

a housing including a gun barrel having a discharge chamber and a discharge nozzle through which water is to be discharged;

a handle grippable by one hand of a user for carrying the water gun and for aiming the gun barrel towards a target;

a water reservoir carried by said housing for holding a quantity of water;

a manually-driven pump having a pumping chamber and a handpiece grippable by the other hand of the user and reciprocatable along an axis parallel to that of the barrel for pumping water from said water reservoir to produce a discharge of water through said nozzle via said pumping and discharge chambers;

and a water discharge control presettable by the user to different preset positions enabling the user to produce, during one preset position thereof, a large quantity blast water discharge from said gun barrel towards the target for drenching purposes, and during another preset position thereof, a rapid sequence of small-quantity water discharges for simulating rapid shots of an automatic gun;

wherein said water discharge control includes first and second manually-presettable devices for controlling the volume of said discharge chamber, wherein there is a single water reservoir to produce the discharge of water through the discharge nozzle via the pumping and discharge chambers, wherein said second manually-presettable device includes a plunger within said discharge chamber counted to said handpiece reciprocatable by the user along an axis parallel to that of the barrel, and wherein the movement of said plunger within said discharge chamber is guided by a slot in the housing defining the discharge chamber, and is locked in the desired position by locking recesses formed in said slot.

2. The toy water gun according to claim 1, wherein said first manually-presettable device is a cover threadedly received at one end of a housing defining said discharge chamber, which cover includes a central opening for receiving said discharge nozzle.

3. The toy water gun according to claim 2, wherein the opposite end of said housing defining said discharge chamber is formed with an inlet laterally offset from said central opening in the cover receiving said discharge nozzle.

4. The toy water gun according to claim 1, wherein said water discharge control also produces, in a further preset position thereof, a single small-quantity water discharge simulating a single shot of a gun.

5. The toy water gun according to claim 1, wherein said discharge chamber includes an outlet end communicating with the discharge nozzle of said barrel, and an inlet end communicating with said manually-driven pump;

and wherein said water discharge control includes a pressure-sensitive, snap-action valve at said outlet end of said discharge chamber, which valve is normally closed but which automatically opens with a snap-action when the pressure in said discharge chamber reaches a predetermined maximum pressure, and automatically recloses with a snap-action when the pressure in said discharge chamber drops to a predetermined lower pressure than said predetermined maximum pressure.

6. The toy water gun according to claim 5, wherein said water discharge control further includes a flow-rate selector between said manually-driven pump and said discharge chamber which is presettable to produce either said large quantity water discharge or said rapid sequence of small quantity water discharges.

7. The toy water gun according to claim 1, wherein there is a single water reservoir to produce the discharge of water through the discharge nozzle via the pumping and discharge chambers.

8. The toy water gun according to claim 1, wherein said toy water gun further comprises a pivotal trigger which, when pivotted, produces a single, small-quantity discharge from the water reservoir simulating a single shot of a gun.

9. The toy water gun according to claim 1, wherein:

the water gun further comprises a second discharge chamber having a second discharge nozzle through which water is to be discharged; and the handpiece of the manually-driven pump is responsible for pumping water from the water reservoir to the first-mentioned discharge chamber to produce the large-quantity water discharge from the first mentioned nozzle for drenching purposes, or the rapid sequence of small-quantity water discharges for simulating rapid shots of an automatic gun.

10. The toy water gun according to claim 9, wherein each of said discharge chambers includes a snap-action pressure-responsive valve including:

a valve opening in a fixed wall of the respective discharge chamber;

a stem fixed adjacent to said fixed wall on the side thereof facing a movable wall;

a liquid inlet port through said stem;

and a valve member carried by said stem and normally closing said valve opening in said fixed wall of the respective discharge chamber;

said fixed wall of the respective discharge chamber being elastically deformable by the pressure within said respective discharge chamber such as to produce a snap-action opening of said valve member with respect to said valve opening upon the pressure within the respective discharge chamber reaching said predetermined value.

11. The toy water gun according to claim 9, wherein there is a single water reservoir to produce the discharge of water through the discharge nozzle via the pumping and discharge chambers.

12. The toy water gun according to claim 8, wherein said water discharge control further includes a slow-rate selector between said manually-driven pump and said discharge chamber which is presettable to produce either said large-quantity water discharge, or said rapid sequence of small-quantity water discharges.

* * * * *